US010471621B2

(12) United States Patent
Fürst et al.

(10) Patent No.: US 10,471,621 B2
(45) Date of Patent: Nov. 12, 2019

(54) CUTTING DEVICE WITH EXCHANGING DEVICE FOR THE CUTTER BAR

(71) Applicant: STARLINGER & CO GESELLSCHAFT M.B.H., Vienna (AT)

(72) Inventors: Herbert Fürst, Bad Vöslau (AT); Dietrich Wolf, Siegersdorf (AT)

(73) Assignee: STARLINGER & CO GESELLSCHAFT M.B.H., Vienna (AT)

( * ) Notice: Subject to any disclaimer, the term of this patent is extended or adjusted under 35 U.S.C. 154(b) by 498 days.

(21) Appl. No.: 15/027,299

(22) PCT Filed: Sep. 24, 2014

(86) PCT No.: PCT/EP2014/070359
§ 371 (c)(1),
(2) Date: Apr. 5, 2016

(87) PCT Pub. No.: WO2015/051995
PCT Pub. Date: Apr. 16, 2015

(65) Prior Publication Data

US 2016/0243717 A1 Aug. 25, 2016

(30) Foreign Application Priority Data

Oct. 7, 2013 (EP) ..... 13187527

(51) Int. Cl.
*B26D 1/03* (2006.01)
*B26D 7/26* (2006.01)
(Continued)

(52) U.S. Cl.
CPC ..... *B26D 7/2628* (2013.01); *B26D 1/035* (2013.01); *B26D 1/455* (2013.01); *B26D 5/02* (2013.01);
(Continued)

(58) Field of Classification Search
CPC ..... B26D 1/03; B26D 1/035; B26D 1/095; B26D 1/115; B26D 1/26; B26D 1/265;
(Continued)

(56) References Cited

U.S. PATENT DOCUMENTS 1,642,081 A * 9/1927 Munroe ..... B26D 1/205 19/161.1
RE27,727 E 8/1973 Kim et al.
(Continued)

FOREIGN PATENT DOCUMENTS

DE 1921182 A1 * 11/1970 ..... B26D 1/035
DE 2101538 A1 * 8/1972 ..... B26D 1/035
(Continued)

OTHER PUBLICATIONS

International Preliminary Report on Patentability of PCT/EP2014/070359, dated Apr. 21, 2016, filed Sep. 24, 2014.
(Continued)

*Primary Examiner* — Evan H MacFarlane
(74) *Attorney, Agent, or Firm* — Workman Nydegger

(57) ABSTRACT

Cutting device for longitudinally cutting a film web, in particular a plastic film web, moved in a web plane in a transport direction into a plurality of film bands, wherein a first cutter bar provided with cutting blades is immersed with the cutting blades in a cutting position into the web plane. In order to replace the cutter bar, a second cutter bar provided with cutting blades may be immersed with its cutting blades into the web plane, wherein the first cutter bar may be moved from the cutting position into a transfer position outside of the web plane when the second cutter bar is immersed with its cutting blades into the web plane.

16 Claims, 6 Drawing Sheets

Figure 1:
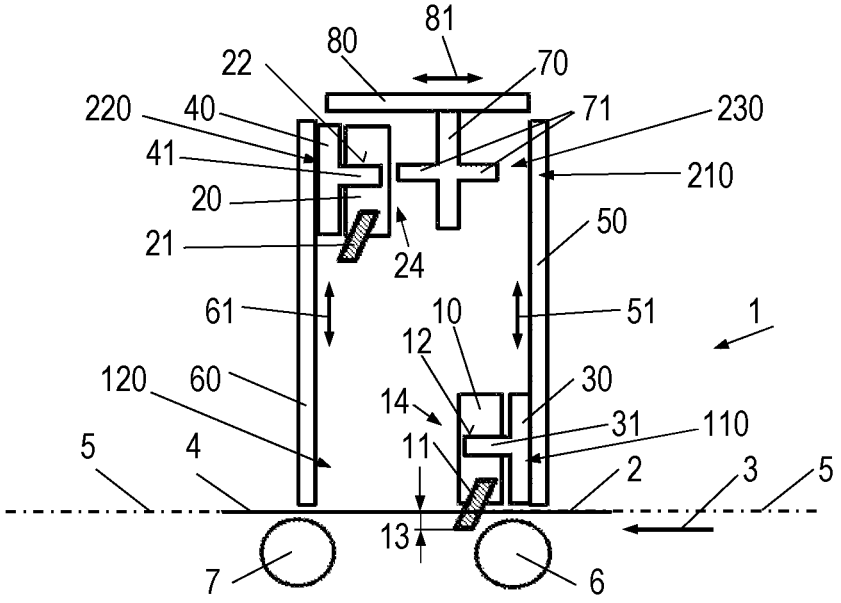

(51) Int. Cl.

| | |
|---|---|
| ***B26D 5/02*** | (2006.01) |
| ***B26D 5/08*** | (2006.01) |
| ***B26D 7/12*** | (2006.01) |
| ***B26D 1/45*** | (2006.01) |

(52) U.S. Cl.
CPC ..... *B26D 5/08* (2013.01); *B26D 7/12* (2013.01); *B26D 7/26* (2013.01)

(58) Field of Classification Search
CPC B26D 2007/2657; B26D 7/26; B26D 7/2628; B26D 7/2642; B26D 7/2614; B26D 1/45; B26D 1/455; B26D 5/02; B26D 5/04; B26D 5/06; B26D 5/08; B26D 7/12; B65H 35/02; B65H 35/08; B65H 2301/4148; D01D 5/42; D01D 5/426; Y10T 83/6603; Y10T 83/4757; Y10T 83/6584–83/6588; Y10T 83/659
USPC ..... 242/525, 525.5; 83/433, 425, 425.1, 83/425.2, 425.3, 425.4

See application file for complete search history.

(56) References Cited

U.S. PATENT DOCUMENTS

| | | | | |
|---|---|---|---|---|
| 3,961,547 | A * | 6/1976 | Shainberg | B23D 35/008 74/424.78 |
| 4,831,909 | A * | 5/1989 | Peters | B26D 1/035 83/425.4 |
| 2003/0084768 | A1 * | 5/2003 | Adami | B26D 1/425 83/300 |

FOREIGN PATENT DOCUMENTS

| | | | | |
|---|---|---|---|---|
| DE | 2126027 | A1 | 12/1972 | |
| DE | 3137826 | A1 | 5/1982 | |
| DE | 3151348 | A1 * | 2/1984 | B26D 1/035 |
| DE | 19843428 | A1 | 4/1999 | |
| DE | 20306757 | U1 | 8/2003 | |
| EP | 0737553 | A1 | 10/1996 | |
| IT | 1138943 | B | 9/1986 | |
| WO | WO-2015033369 | A1 * | 3/2015 | B65H 35/02 |

OTHER PUBLICATIONS

Written Opinion of PCT/EP2014/070359, filed Sep. 24, 2014.
International Search Report of PCT/EP2014/070359, dated Jan. 12, 2015, filed Sep. 24, 2014.

* cited by examiner

CUTTING DEVICE WITH EXCHANGING DEVICE FOR THE CUTTER BAR

The present application is a U.S. National Stage of International Application No. PCT/EP2014/070359, filed on Sep. 24, 2014, designating the United States and claiming the priority of European Patent Application No. 13187527.0 filed with the European Patent Office on Oct. 7, 2013. All of the aforementioned applications are incorporated herein in their respective entireties by this reference.

The invention relates to a cutting device for longitudinally cutting a film web moved in a web plane in a transport direction, in particular a plastic film web having the features of the preamble of claim 1. The invention further comprises a cutting method using a cutting device.

From prior art there is known a plurality of embodiments for cutting materials such as plastic films that are moved web-like in the longitudinal direction into a plurality of film bands. Longitudinally cutting the film is usually carried out by passing a film web at several cutting blades arranged at a cutter bar. Increasing plant speeds, however, leads to higher wear of these cutting blades, which is why these have to be replaced more frequently. In order to replace the cutter bars, the entire production plant usually has to be brought to a standstill, which disadvantageously will lead to a production stop as well as to increased production costs.

In order to reduce the frequency of the replacement of cutter bars, there have been developed so-called rotational cutter bars, such as can be found, e.g., in the document DE 31 37 826 A1. Therein, there are provided cylindrical cutter bars, at the periphery of which there are arranged several rows of cutting blades, which may be rotated further from one row of cutter blades to the next row of cutting blades, which may be carried out with the cutting plant in operation. If, however, the blades of all blade rows are blunt, then the entire production plant still has to be shut down and the complete cylindrical cutter bar has to be replaced. By the use of such a rotational cutter bar, there will be achieved longer run times of a plant, which, however, still has to be shut down for replacing the cutter bar, hence interrupting production in any case. Furthermore, the production of a rotational cutter bar is accordingly cumbersome.

In another embodiment of longitudinal cutting devices, which can be found in the publication DE 21 26 027 A1, there are provided disc-shaped knives at a cutter bar, which is rotatable in the opposite direction to the running direction of the film web. In this way, the knive blade speed is lower than the transport speed of the film, which is why wear of the disc-shaped knife blades will be delayed. But also herein, once the disc-shaped knife blades are blunt at their peripheral section provided with cutting blades, the entire cutter bar has to be replaced on a regular basis, and the plant has to be shut down.

It was possible to increase the productivity of band extrusion plants by delaying the wear of the cutting devices, these plants, however, still have to be shut down for the replacement of the cutter bars, which has negative effects on productivity.

For this reason, it is the task of the present invention to provide a cutting device, which avoids the described disadvantages of prior art and which enables a continuous plant operation, without having to shut down the production plant every time for a blade replacement.

This task is solved in a cutting device according to the preamble of claim 1 by the features of the characterizing part of the claim 1. The sub-claims relate to further especially advantageous embodiments of the invention.

In an inventive cutting device for longitudinal cutting a film web, in particular a plastic film web, moved in a web plane in a transport direction into a plurality of film bands, wherein a first cutter bar provided with cutting blades is immersed with the cutting blades in a cutting position into the web plane, a second cutter bar provided with cutting blades is immersible with its cutting blades into the web plane, and the first cutter bar is moveable from the cutting position into a transfer position outside of the web plane when the second cutter bar is immersed with its cutting blades into the web plane.

In a cutting device according to the invention, the replacement of the cutter bars may advantageously take place automatically with the plant in operation. Before a first cutter bar is moved from the cutting position thereof into a transfer position outside of the web plane, there has already been immersed a second cutter bar with the cutting blades thereof into the web plane, by means of which there is enabled a continuous, interruption-free operation of the cutting device even at high web speeds of the film web. Replacing the cutter bars with the plant in operation will mostly be initiated at the first indications that the cutting blades of the cutter bar currently positioned in a cutting position will become blunt and/or that the cutting profile of the film bands shows irregularities. Thus, the second cutter bar immerses in a second cutting position with the cutting blades thereof into the web plane, and subsequently the first cutter bar is moved from the cutting position into a transfer position outside of the web plane.

Depending on the embodiment of the cutting device according to the invention it is conceivable that, when the cutter bars are being replaced, each cutter bar will penetrate or immerse, respectively, viewed in the transport direction, at an upstream as well as a downstream cutting position into the film web.

Alternatively, there is provided in the context of the invention that the second cutter bar immerses respectively in the transport direction downstream of the cutter bar being positioned currently in the preferred upstream cutting position into the web plane, with the cutting blades of this second cutter bar each thus engaging the spaces between the film bands already cut in the longitudinal direction. The distances between the individual cutting blades transversely to the transport direction along the cutter bar are defined by corresponding spacers between the cutting blades, by means of which also a width of the individual film bands is determined. By way of appropriate adjustment devices such as, e.g., centering pins or the like, which are intended for guiding or holding, respectively, the cutter bars, there is ensured that the cutting blades of the cutter bars immersing into the web plane of the film web during the replacement of the cutter bars are positioned exactly so that the cutting blades each engage the spaces between the film bands already cut in the longitudinal direction. In this way, tearing of the bands is avoided when the cutter bars are being replaced, and also the cutting profile of the film bands remains without or almost without errors or irregularities during the replacement of the cutter bars.

A cutter bar having already worn, blunt cutting blades may be moved from a transfer position outside of the web plane especially conveniently into a removal position and then be replaced, without impeding the running operation of the cutting device. In the context of the invention it is further conceivable to remove a blunt cutter bar that is to be replaced directly at a transfer position outside of the web plane of the cutting device or to introduce a new cutter bar at a transfer position again into the cutting device, respectively.

In a cutting device according to the invention the cutter bars are especially advantageously movable respectively essentially vertically to the web plane from the cutting position into a transfer position and/or vice versa. In this preferred embodiment variant of the invention, the cutter bars are moved in vertical direction to the web plane in order to reach the transfer position and from there further to a removal position in order to enable removal thereof at the removal position for maintenance or replacement of the cutting device. Vice versa, new cutter bars or cutter bars having bevelled or newly inserted cutting blades, respectively, are inserted at the removal position and then moved on to a transfer position in order to being moved from this transfer position in an essentially vertical direction into the cutting position. In a preferred embodiment of the invention, the cutting blades of the prepared cutter bar of the cutting position immerse into the web plane of the film web, wherein the cutting blades of the cutter bar when immersed exactly engage the spaces between the individual film bands. Using this embodiment, in which the transfer positions of the cutter bars are positioned vertically above the film web, for example, there may be realized an especially compact construction of the cutting device according to the invention.

Suitably, in a development of the invention the cutter bars are slidable in a cutting device respectively along guiding devices that are essentially vertical to the web plane. As guiding devices for the exact shifting of the cutter bars, for example, profiled guiding rails are suitable.

In a cutting device according to the invention each cutter bar may especially advantageously be attached releasably at a cutter bar holder, which assumes the holding and guiding function for the cutter bars. The cutter bars may therein be attached at the cutter bar holder using fastening systems that are known from prior art. In the scope of the invention it is further conceivable to provide quick release fasteners for attachment of the cutter bars at the cutter bar holders in order to enable an especially quick replacement of the cutter bars.

In a preferred embodiment variant of the invention in a cutting device each cutter bar has accommodation devices for accommodating fastening devices at the cutter bar holder. Therefore, there are provided at the cutter bar, for example, one or more accommodation bores as accommodation devices, which are intended to accommodate, for example, centering pins as fastening devices. Within the scope of the invention it is further conceivable to provide other or additional, respectively, releasable connection variants for attaching the cutter bars at the respective cutter bar holder.

In a cutting device according to the invention, the cutter bar holders are usefully arranged slidably along guiding devices. In this embodiment variant there is achieved an especially precise guiding of the cutter bars along the guiding devices.

In a development of the invention the cutting positions of the cutter bars are arranged in a cutting device, which further comprises an upstream web carrier as well as a downstream web carrier for guiding the film web to be cut in the web plane, between the upstream web carrier and the downstream web carrier. In this embodiment there is advantageously guaranteed that the film web that is moved is situated at the cutting positions of the cutter bars respectively in a linear orientation within the web plane, thus guaranteeing an especially exact cutting profile of the film bands. Due to the web carriers that are arranged upstream and downstream, respectively, of the cutter bars there are avoided lateral deviations or vibrations of the film web in this web section, and the cutting blades of the cutter bars each immerse into the spaces between the film bands in the web plane. Rollers or rolls may, for example, serve as web carriers for guiding the film web.

In a cutting device according to the invention an upstream cutting position of the cutter bars is especially advantageously arranged between the upstream web carrier and the downstream web carrier in the transport direction, immediately following the upstream web carrier. In this preferred cutting position the cutting blades of the cutter bar are immersed in the transport direction immediately following the upstream web carrier into the web plane of the film web. Any undesired lateral offset or impeding vibrations of the film web that is moved are, hence, avoided in this web section due to the spatial vicinity of the upstream cutting position of the cutter bar to the upstream web carrier.

In a further embodiment according to the invention, in a cutting device a displacing device moves a cutter bar from the downstream cutting position in the web plane in the opposite direction to the transport direction of the film web into a preferred upstream cutting position wherein the cutting blades each remain immersed into the web plane of the film web or are shifted within the web plane in the opposite direction to the transport direction of the film web. In this way, the cutting position of the cutter bar may be moved in the opposite direction to the transport direction of the film web into the upstream cutting position that is to be preferred, without impeding the cutting profile of the film bands.

In a cutting device according to the invention the displacing device is especially advantageously arranged slidably in an axial direction in parallel to the web plane. In this way there is guaranteed that the cutting blades of that cutter bar that is currently in the cutting position will remain immersed into the web plane of the film web also during the shifting of the cutter bar.

In a cutting device according to the invention the displacing device is usefully provided with at least one shifter, which may be shifted by a drive, preferably by a linear drive or a spindle drive, in the axial direction in parallel to the web plane. Therefore, the drive acts on one or more shifters, which guide the cutter bar in the axial direction in parallel to the web plane during shifting. The accuracy of the shift movement is advantageously increased by using linear or spindle drives. Also by using two or more shifters, which each engage during shifting, for example, laterally in the two opposite narrow sides of the cutter bar to be shifted, an especially exact, parallel shifting of the cutter bar from a downstream cutting position into an upstream cutting position will be ensured. The cutter bar is thus removed from the fastening devices of the cutter bar holder situated in the downstream cutting position, and it is shifted or placed, respectively, in the opposite direction to the transport direction of the film web onto the fastening devices of the cutter bar holder situated in the upstream cutting position. The fastening devices of at least one of the two cutter bar holders situated in the cutting position will engage, during the shift movement, the accommodation devices of the cutter bar to be shifted, thus in addition supporting the exact guiding of the cutter bar during shifting.

In an especially advantageous embodiment variant of the invention a transfer carrier serves in a cutting device to receive at least one of the cutter bars from a lateral transfer position and/or to transfer at least one of the cutter bars into a lateral transfer position, and it is, hence, movably arranged at a guiding device between two lateral transfer positions.

The transfer carrier is intended to simplify replacement of the cutter bars and to receive cutter bars to be replaced from a transfer position or, in contrast thereto, to transfer cutter bars at a transfer position so that these may be moved from this transfer position again into a cutting position.

In a development of the invention the transfer carrier may be shifted in a cutting device along the guiding device into a central removal position, which is situated in-between the transfer positions, for replacing the cutter bars. In this embodiment the cutter bars are transferred from the lateral transfer positions to the transfer carrier, upon which the transfer carrier may be shifted into a removal position at any suitable position between the transfer positions for an especially easy replacement of the cutter bars. In this way, access to the cutter bars to be replaced is advantageously improved.

In a further alternative embodiment variant of the invention the transfer carrier may be shifted in a cutting device into a lateral removal position, transversally to the transport direction as well as laterally of the film web, for replacing the cutter bars. In this embodiment the lateral removal position is shifted between the two lateral transfer positions as well as additionally in respect to the central removal position also transversally to the transport direction and thus laterally to the film web for replacing the cutter bars. The cutter bar may be accessed especially easily in this removal position that is shifted or swivelled, respectively, in respect to the film web in a lateral way, and it may be replaced rather conveniently.

In a cutting device according to the invention am immersion depth of the cutting blades into the web plane may be adjusted in height. In this advantageous embodiment variant of the invention the cutting blades may be adjusted in their immersion depth into the web plane of the film web. By fine adjustment of the immersion depth the cutting blades may each be used alongside a blade section and not only at one and the same cutting point. Thus, the service time of one and the same cutter bar may be increased, without having to move it out of its cutting position.

In a development of the invention a cutting device further includes control and/or feedback control devices for the fully automatic replacement of the cutter bars as well as for the fine adjustment of the guiding devices. In this embodiment films may advantageously be cut by means of a cutting device according to the invention at especially high transport speeds, as the control and/or feedback control devices guarantee a fine adjustment of the guiding devices and, hence, an especially exact cutting profile. Due to the fully automatic replacement of the cutter bars, there is further guaranteed a continuous and exact cutting course.

The invention also comprises a method for longitudinally cutting a film web, in particular a plastic film web moved in a web plane in a transport direction, into a plurality of film bands by means of a cutting device according to the invention, wherein the following process steps are performed:

- immersion of a first cutter bar provided with cutting blades with its cutting blades in a cutting position into the web plane of the film web,
- immersion of a second cutter bar provided with cutting blades with its cutting blades in a cutting position into the web plane, wherein the cutting blades of this second cutter bar each engage in the spaces between the film bands already cut in the longitudinal direction,
- subsequent movement of the first cutter bar from the cutting position into a transfer position outside of the web plane.

Figure 10:
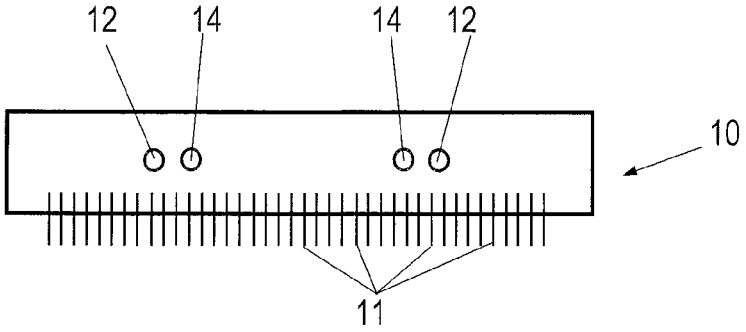
Figure 11:
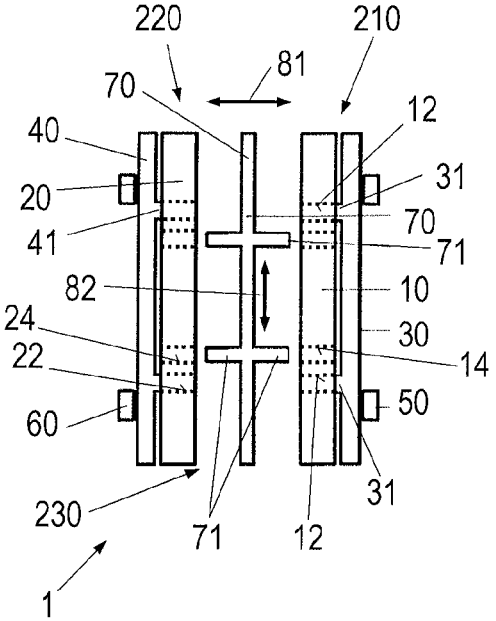
Figure 12:
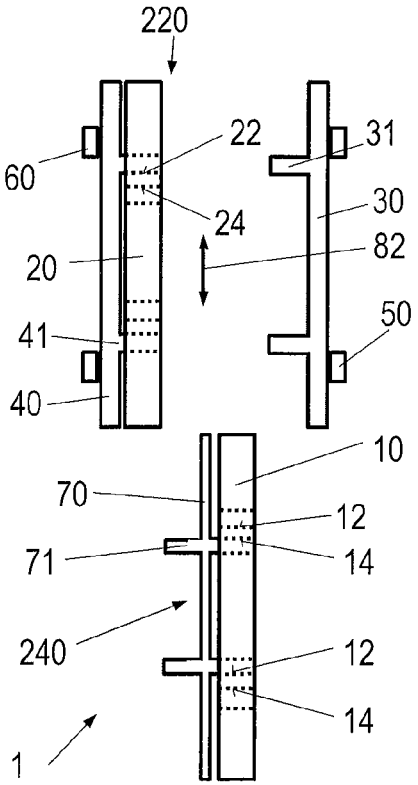
Figure 13:
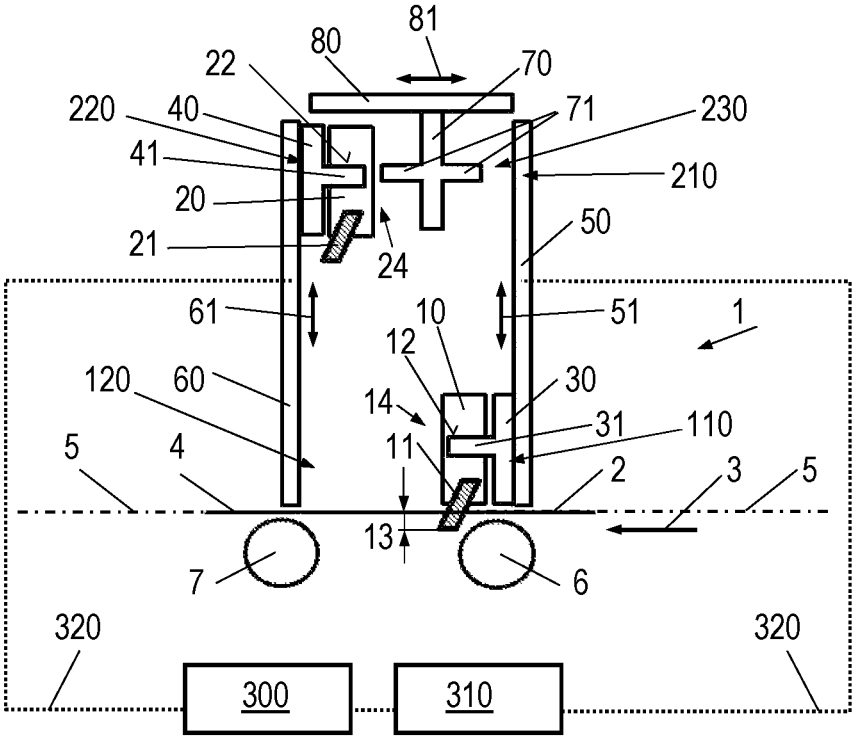

Further details, features and advantages of the invention will become obvious from the following description of an exemplary embodiment schematically illustrated in the drawings. In the drawings there is shown:

in FIG. 1 to FIG. 9 respectively in side sections a temporal sequence of the automatic replacement of the cutter bars in operation of a cutting device according to the invention;

in FIG. 10 in a front view a disassembled cutter bar;

in FIG. 11 and in FIG. 12 respectively in a top view the cutting device illustrated in the FIGS. 1 to 9.

in FIG. 13 in a sectional side view a cutting device according to the invention having control and feedback control devices for the fully automatic replacement of the cutter bars as well as for the fine adjustment of the guiding devices.

The following illustrations FIG. 1 to FIG. 9 are intended to describe the replacement of cutter bars in a continuous operation of a cutting device 1. As shown, for example, in FIG. 1, a continuous flat film web 2, for example a plastic film web 2, is moved in a transport direction 3 to the cutting device 1. The transport direction 3 of the film web 2 is indicated in the illustration respectively by an arrow 3. The plastic film web 2 is cut by the cutting device 1 into a plurality of film band 4 of a defined band width. The plastic film web 2 as well as the individual parallel film bands 4 are thus moved in a web plane 5. In order to guide the film web 2 to be cut there are arranged an upstream web carrier 6, which is arranged in relation to the transport direction 3 upstream at the cutting device 1, as well as a downstream web carrier 7 at the downstream end of the cutting device 1. The two web carriers 6 and 7 are each herein embodied, for example, as guiding rolls or guiding rollers, guaranteeing a flat position of the film web 2 to be cut and of the film bands 4 already cut in the longitudinal direction, respectively, in the plane web 5. Undesired flattering or lateral offset, respectively, in particular with a fast running film web 2 are successfully prevented by the two web carriers 6 and 7 at least in this web section.

In FIG. 1, which shows a cutting device 1 according to the invention in operation, a first cutter bar 10, which is provided at its underside with cutting blades 11 and which has accommodation devices 12, 14 for its fastening or adjustment, respectively, is immersed into the web plane 5 of the film web 2 at an immersion depth 13 of the cutting blades 11. The first cutter bar 10 is therein situated in an upstream cutting position 110, which is situated, viewed in the transport direction 3, immediately following the upstream web carrier 6. A second cutter bar 20, which is also provided with cutting blades 21 at its underside and which has accommodation devices 22, 24 for its fastening and adjustment, respectively, is currently situated in a transfer position 220 outside of the web plane 5.

The cutting device 1 further comprises cutter bar holders 30, 40, which each have fastening devices 31, 41. Each cutter bar holder 30, 40 is slidably arranged along a guiding device 50, 60. The directions of movement 51, 61 of the cutter bar holders 30, 40 along the guiding devices 50, 60 are each indicated by double arrows 51, 61. The directions of movement 51, 61 are essentially perpendicular to the web plane 5. The cutter bars 10, 20 may each be releasably fastened at a cutter bar holder 30, 40, wherein the accommodation devices 12, 22 of the cutter bars 10, 20 are provided for accommodating the fastening devices 31, 41 at the cutter bar holder 30, 40.

A transfer carrier 70 is intended to receive at least one of the cutter bars 10, 20 from a lateral transfer position 210, 220 or vice versa to transfer at least one of the cutter bars 10, 20 again into a lateral transfer position 210, 220. The transfer carrier 70 is movably arranged between two lateral transfer positions 210, 220, which are situated herein each above the web plane 5. The transfer carrier 70 thereto has fastening devices 71, which engage accommodation devices 14, 24 of the cutter bars 10, 20 dedicated to this purpose for holding or guiding, respectively—comparable with the fastening devices 31, 41 of the two cutter bar holders 30, 40. Each cutter bar 10, 20, hence, has accommodation devices 12, 22 for attachment at the cutter bar holders 30, 40 as well as further accommodation devices 14, 24 for attachment at the transfer carrier 70. The transfer carrier 70 is movably arranged at a guiding device 80. According to the respective embodiment, the transfer carrier 70 thus may be moved back and forth in the direction of movement 81 in parallel to the film web 2 or the web plane 5, respectively, which is indicated in the figures as double arrow 81, between the two lateral transfer positions 210 and 220, and it may be moved into a central removal position 230, which is situated at any position between the transfer positions 210 and 220, for removing a cutter bar 10, 20 to be replaced. The transfer carrier 70 may be especially conveniently moved in addition in a transversal movement 82 of the transfer carrier 70 laterally to the film web 2 and transversally to the transport direction 3, respectively, by means of which a further lateral removal position 240 of the transfer carrier 70 is obtained, which is situated laterally offset next to the film web 2. In this embodiment variant the access to the cutter bar 10, 20 to be replaced is further improved, and replacing the cutter bar may take place especially conveniently and rapidly. The lateral transversal movement 82 of the guiding device 80 is indicated in the illustrations FIG. 7 as well as FIG. 11 or FIG. 12, respectively, as a double arrow 82. The central removal position 230 of the transfer carrier 70 is illustrated in FIG. 11. FIG. 12 shows the transfer carrier 70 in the further lateral removal position 240, which is situated laterally next to the film web 2 arranged underneath.

Figure 5:
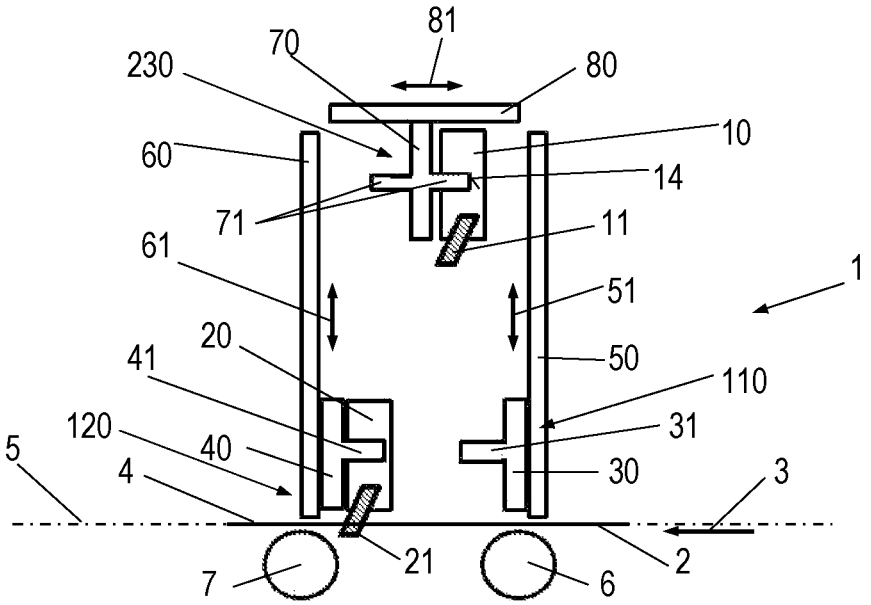
Figure 6:
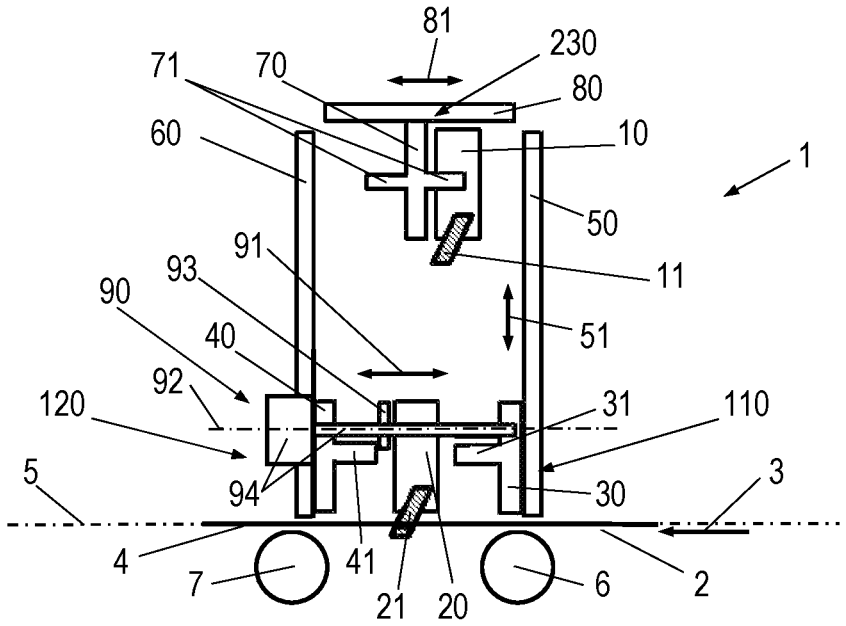

FIG. 6 illustrates the action of a displacing device 90, which is intended to move a cutter bar 10, 20, with the plant in operation, from a downstream cutting position 120 in the web plane 5 in the opposite direction to the transport direction 3 of the film web 2 into an upstream cutting position 110. For the sake of clarity, the displacing device 90 is depicted only in FIG. 6, being omitted in the further side views FIG. 1 to FIG. 5 as well as FIG. 7 to FIG. 9. In FIG. 6 the direction of movement of a shift 91 of the shifter 93 of the displacing device 90 is indicated as a double arrow 91. The displacing device 90 ensures that herein the cutter bar 20 is moved in an axial direction 92 in parallel to the web plane 5. For this reason, herein two shifters 93, for example, engage each laterally at the cutter bar 20 to be shifted and move this in the direction of the arrow 91 in the opposite direction to the transport direction 3. The shifters 93 are moved using a drive of the displacing device 90, e.g. using a linear drive 94 or a spindle drive. In this embodiment there is ensured that it is that cutter bar 10, 20, which is currently engaged in the web plane 5 of the film web 2 with the cutting blades 11, 21 thereof, that may be moved from the downstream cutting position 120 into the opposite upstream cutting position 110, with the plant in operation, without the cutting profile of the film bands 4 being impeded or ruptures of the bands being caused. Within the scope of the invention there may also be used other comparable embodiments of displacing devices 90.

The cycle of replacement of the cutter bars 10, 20 in a continuous operation of a cutting device 1 is herein described by way of the exemplary embodiment shown in the illustrations FIG. 1 to FIG. 9 as follows: If the cutting blades 11 of the first cutter bar 10 are already blunt in the cutting position 110 in FIG. 1, then the cutter bar 10 has to be replaced. For this reason, there is already positioned a prepared new second cutter bar 20 in the transfer position 220.

Figure 2:
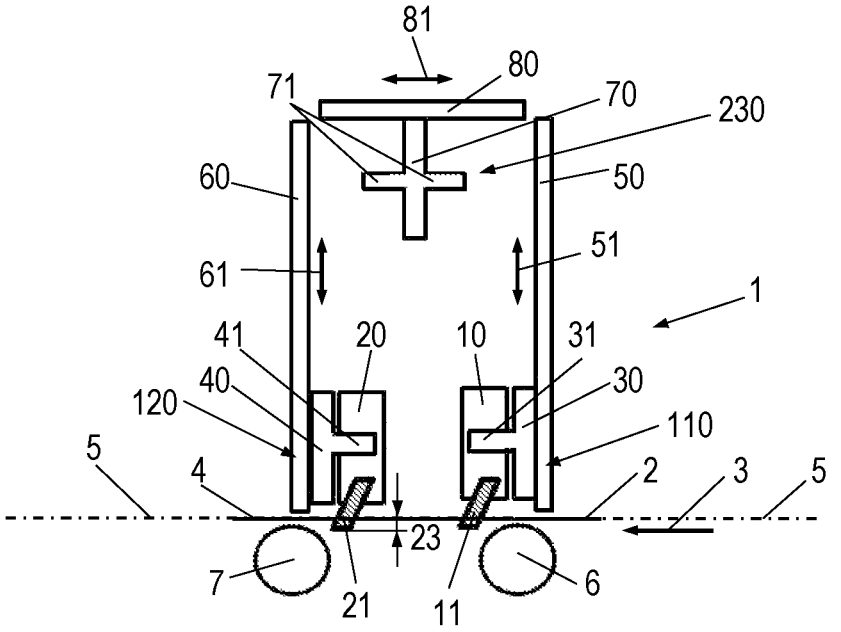

As illustrated in FIG. 2, the second cutter bar 20 comprising the cutter bar holder 40 is then moved in the direction of movement 61 essentially vertically downwards along the guiding device 60 until this second cutter bar 20 is immersed with the cutting blades 21 thereof in a cutting position 120 into the web plane 5 of film bands 4. At this point, the first cutter bar 10 as well as the second cutter bar 20 are in cutting positions, wherein the cutting blades 11, 21 of both cutter bars 10, 20 are immersed into the web plane 5 of the film web 2 at an immersion depth 13, 23. The position 120 for immersion of the cutting blades 21 of the second cutter bar 20 is herein, viewed in the transport direction 3, downstream of the cutting position 110 of the first cutter bar 10.

When immersing the cutting blades 21 of the second cutter bar 20, there has to be ensured that the cutting blades 21 are introduced exactly into the cutting gap of the cutter bar 10 in order to avoid damage to the film bands 4. On the one side, the distance between the individual cutting blades 11, 21 at the cutter bar 10, 20 is defined by spacers between the blades, and, on the other side, the position of the cutter bar 10, 20 is determined respectively by accommodation devices 12, 22, for example accommodation bores 12, 22, at the cutter bar 10, 20 and by the respective fastening devices 31, 41, for example centering pins 31, 41, of the utter bar holders 30, 40. In this way there is guaranteed that the position of the cutting blades 11, 21 of the cutter bars 10, 20 always corresponds exactly in the longitudinal cutting direction of the film web 2 to the spaces between the film bands 4—each independent of the respective cutting position 110, 120.

Figure 3:
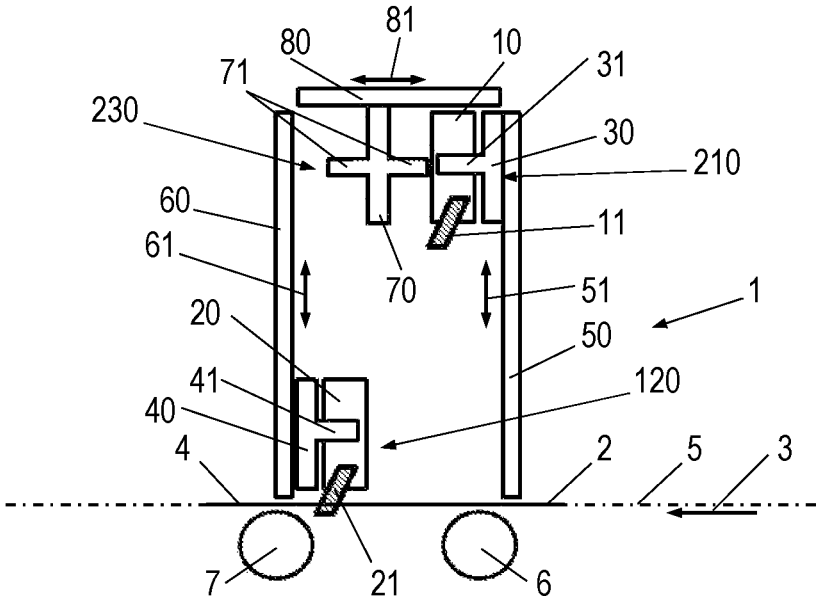
Figure 4:
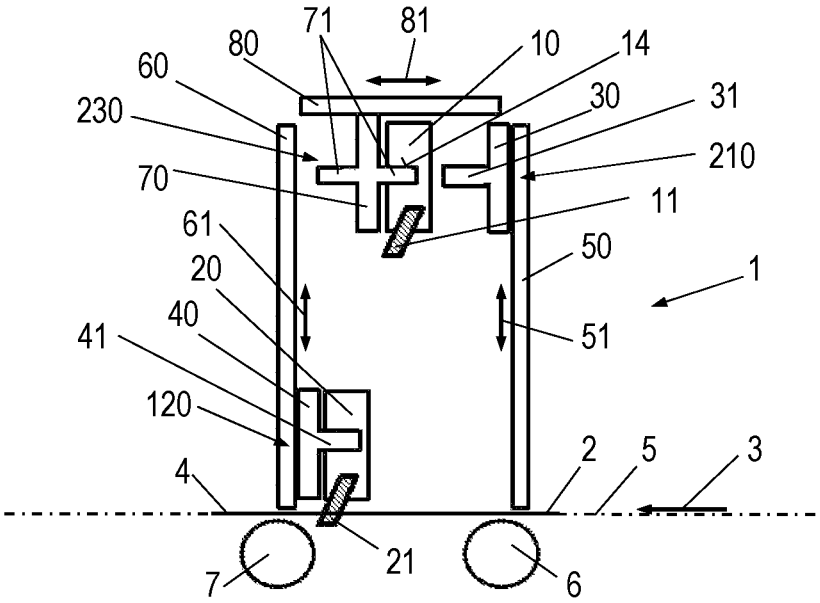

In FIG. 3 there is shown that subsequently the first cutter bar 10, which has become blunt, is moved from its cutting position 110 with the cutter bar holder 30 along the guiding device 50 in the direction of movement 51 essentially vertically upwards into the transfer position 210. The cutting blades 21 of the first cutter bar 10 are thus not situated in the web plane 5 anymore. The second cutter bar 20 alone, hence, assumes the cutting function in the cutting position 120. Following the blade replacement, the first cutter bar 10 may then be removed according to the embodiment of the cutting device 1 either directly from the transfer position 210, or the first cutter bar 10 is received by the transfer carrier 70, which is depicted in FIG. 4.

For this reason, the centering pins as fastening devices 71 of the transfer carrier 70 are then guided into the accommodation devices 14, which are dedicated exclusively for the replacement of the cutter bar, e.g. the accommodation bores 14, the attachment of the cutter bar 10 at the cutter bar holder 30 is released, and the cutter bar 10 is transferred to the transfer carrier 70. The transfer carrier 70 is moved with the blunt cutter bar 10 along the guiding device 80 in the direction of arrow 81 into a central removal position 230, and it may then be conveniently reached and removed from the cutting device 1. In order to further facilitate the replacement of the cutter bars 10, 20, it is further provided within the scope of the invention that the transfer carrier 70 may be moved, according to embodiment, in addition also in the direction of movement 82 transversally or laterally, respectively, to the transport direction 3 of the film web 2 out of the cutting device 1, by means of which this further lateral removal position 240 laterally above the film web 2 may be reached especially easily and conveniently. The lateral direction of movement 82 of the guiding device 80 of the transfer carrier 70 may be seen, for example, in FIG. 11 or in FIG. 12, wherein FIG. 11 shows the transfer carrier 70 in a central removal position 230 and FIG. 12 shows the transfer carrier 70 in a further lateral removal position 240.

The empty cutter bar holder 30 is then moved without the cutter bar 10 again essentially vertically in the direction of movement 51 along the guiding device 50 downwards into the cutting position 110, which is illustrated in FIG. 5.

As shown in FIG. 6, the attachment of the second cutter bar 20, which is situated at the cutter bar holder 40 in a lateral cutting position 120, is released, and the cutter bar 20 is then shifted by two shifters 93 of the displacing device 90 in the shifting direction 91 or in the axial direction 92, respectively, and then transferred to the cutter bar holder 30, which is situated in the preferred cutting position 110. According to embodiment, there may arranged, for example, also only one shifter 93 or, as is the case herein, several shifters 93 in a displacing device 90, which, e.g., will engage the two opposite ends of the cutter bar 20 and thus enable a parallel shift 91 of the respective cutter bar to be shifted.

The shifter 93 of the displacing device 90 is therefore driven herein by means of a linear drive 94 in order to move the cutter bar 20 in the opposite direction to the transport direction 3 of the film web 2 along the web plane 5 as precisely as possible to the cutter bar holder 30 into the cutting position 110. Therein it is of uttermost importance that the cutter bar 20 is guided exactly in parallel to the cutter bar holder 40 or exactly in the longitudinal direction of the film web 2, respectively, so that the film bands 4 are also cut exactly during this shifting process. The cutter bar 20 is transferred to the fastening devices 31 of the cutter bar holder 30 and attached thereto accordingly.

Figure 7:
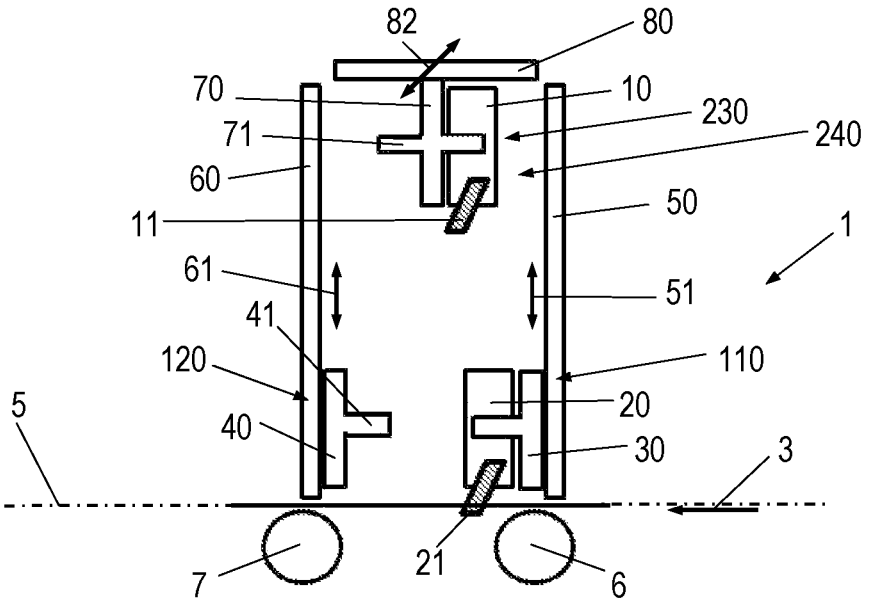

In FIG. 7 the first cutter bar 10 that has become blunt is still in a central removal position 230 at the transfer carrier 70.

Figure 8:
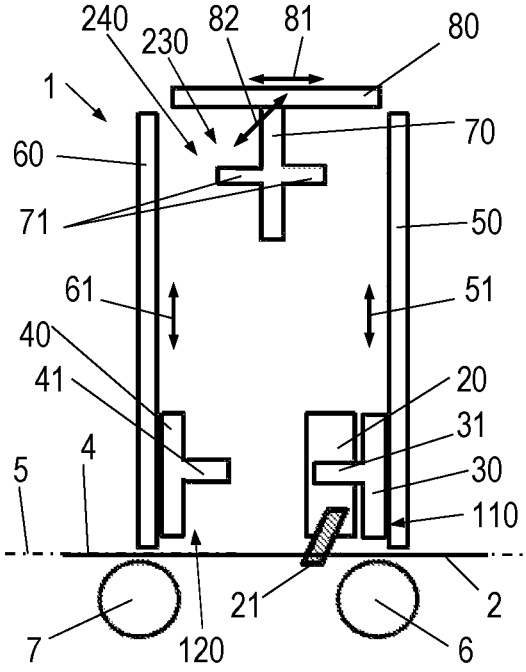

FIG. 8 illustrates the cutting device 1, after the transfer carrier 70 has been emptied and the first cutter bar 10 that has become blunt has been removed for replacing the device.

Figure 9:
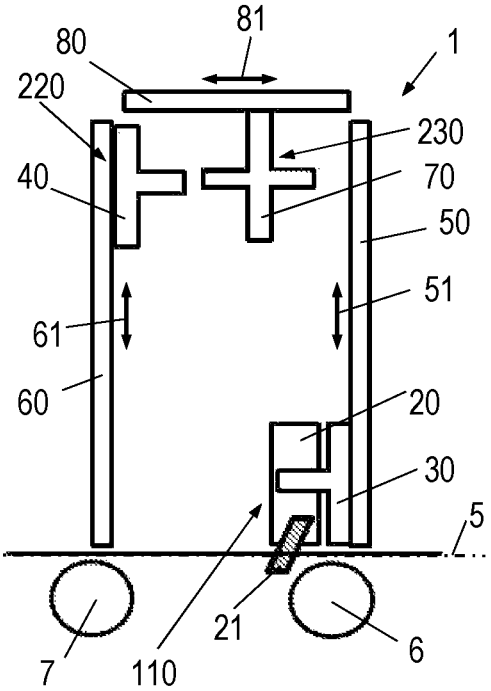

According to FIG. 9 the cutter bar holder 40 is subsequently moved from the cutting position 120 in the direction of movement 61 along the guiding device 60 essentially vertically upwards into the lateral transfer position 220, where the transfer of a new cutter bar optionally by the transfer carrier 70 or by direct placement or attachment, respectively, at the cutter bar holder 40 in the lateral transfer position 220 may be performed. The first cutter bar 10 having newly sharpened or replaced cutting blades 11 and/or the further additional cutter bar having new cutting blades, which is not depicted, may then be optionally used and attached at the cutter bar holder 40, as this is depicted in FIG. 1. In this way, by way of the example shown herein of an embodiment variant of the cutting device 1 according to the invention, a complete cycle of blade replacement is described, with the plant being in operation, analogously followed by another cycle of blade replacement.

In order to make use of the entire blade or a larger blade section of the cutting blades 11, 21, respectively, the position of the cutting blades 11, 21 may be varied with increasing wear in the immersion depth 13, 23 thereof in respect to the web plane 5. This may, for example, be achieved by way of height adjustment of the cutter bar holders 30, 40 or also by way of traverse drums. The cutting angle of the cutting blades 11, 21 in respect to the web plane 5 in this way remains advantageous and, in contrast to rotational cutter bars, also unchanged even in the case of a height adjustment of the immersion depth 13, 23.

FIG. 10 shows in a front view a disassembled cutter bar 10 having a plurality of cutting blades 11, which are each arranged distributed at the same intervals over the length of the cutter bars. As accommodation devices 12 or 14, respectively, for accommodating the fastening devices 31, 41 of the cutter bar holder 30, 40 or of the fastening devices 71 of the transfer carrier 70, respectively, herein there are intended accommodation bores 12, 14. By way of the spatial offset arrangement of the accommodation devices 12 for accommodating the fastening devices 31, 41 of the cutter bar holders 30, 40 in respect to the accommodation devices 14 for accommodating the fastening devices 71 of the transfer carrier 70 there is ensured a friction-free transfer of the cutter bars 10, 20 from the lateral transfer positions 210, 220 to the transfer carrier 70. During transfer, hence, the fastening devices 31 or 41, respectively, of the respective cutter bar holders 30 or 40, respectively, may then simultaneously with the fastening devices 71 of the transfer carrier 70, engage the respective cutter bar 10, 20. The further cutter bar 20 having cutting blades 21 as well as accommodation devices 22 or 24, respectively, has the same construction as the cutter bar 10 shown herein.

FIG. 11 shows in a top view the cutting device 1 that is depicted in the illustrations FIG. 1 to FIG. 9. In the centre of the illustration there is depicted the transfer carrier 70, which may be moved back and forth in the direction of movement 81 between the two lateral transfer positions 210 and 220 in order to serve in the removal position 230 shown herein for accommodating a cutter bar 10, 20 to be replaced.

FIG. 12 relates to the view depicted in FIG. 11 following the transfer of the cutter bar 10 to the transfer carrier 70. This transfer carrier 70 has already been shifted from the central removal position 230 in a lateral direction of movement 82 transversally to the transport direction 3 in order to provide for an especially convenient replacement of the cutter bar 10 attached thereto in this laterally shifted removal position 240, which is shifted laterally to the film web 2 situated underneath.

Further control and/or feedback control devices, which are necessary for a fully automatic replacement of the cutter bar as well as for the fine adjustment of the guiding devices, are not depicted in the schematic illustrations of FIG. 1 to FIG. 12 for the sake of clarity.

In FIG. 13, there is shown a cutting device 1 according to the invention having control devices 300 and feedback control devices 310 for the fully automatic replacement of the cutter bars 10, 20 as well as for the fine adjustment of the guiding devices 50, 60. By way of the control devices 300 as well as the feedback control devices 310, which are connected with the guiding devices 50, 60 by way of signal lines 320, there is guaranteed that the guiding devices 50, 60 are continuously adjusted in an exact way in particular at high transport speeds of the film web 2 and, hence, that a highly exact cutting profile of the film bands 4 as well as an optimal cutting course of the cutting blades 11, 21 is guaranteed. By way of the fully automatic replacement of the cutter bars 10, 20 there is guaranteed a continuous, interruption-free operation of the cutting device 1 even in the case of high web speeds of the film web 2. The control devices 300 and the feedback control devices 310, respectively, may include, if required, any devices such as, for example, one or several cameras, for optically monitoring the cutting profile of the film bands. As soon as the camera detects any irregularities in the cutting profile, there is initiated an automatic replacement of the cutter bars. Similarly, the control device 300 and/or the feedback control device 310 may include one or several computing devices intended for data acquisition and/or data analysis.

The invention is not limited to the embodiments depicted in the illustrations. Within the scope of the invention it is also conceivable to move the cutter bars into transfer positions for the blade replacement, which transfer positions are arranged, for example, due to spatial reasons underneath the web plane and/or laterally of the film web. Within the scope of the invention it is also conceivable to releasably attach the cutter bars directly at the guiding devices in order to provide for an especially compact movement of the cutter bars between the respective cutting positions and transfer positions by way of the guiding devices. In this way, for example, an especially compact constructed embodiment of a cutting device may be realised, which works without a transfer carrier between the two transfer positions and in which the cutting positions of the cutter bars are arranged closely or directly next to each other.

LIST OF THE REFERENCE NUMBERS

1 cutting device
2 film web
3 transport direction of the film web (direction 4 of arrow)
4 film band
5 web plane
6 upstream web carrier (guiding roll)
7 downstream web carrier (guiding roll)
10 (first) cutter bar
11, 21 cutting blade
12, 22 accommodation device for the cutter bar holder
13, 23 immersion depth of the cutting blade into the web plane
14, 24 accommodation device for the transfer carrier
20 (second) cutter bar
30, 40 cutter bar holder
31, 41 fastening device
50, 60 guiding device
51, 61 direction of movement of the cutter bar holder (double arrow)
70 transfer carrier
71 fastening device
80 guiding device
81 direction of movement of the transfer carrier (double arrow)
82 transversal movement of the transfer carrier (double arrow)
90 displacing device
91 shifting direction (double arrow)
92 axial direction of the displacing device
93 shifter
94 linear drive
110 (upstream) cutting position
120 (downstream) cutting position
210, 220 (lateral) transfer position
230 (central) removal position
240 (lateral) removal position
300 control device
310 feedback control device
320 signal line

The invention claimed is:

1. A cutting device for longitudinally cutting a film web moved in a web plane in a transport direction into a plurality of film bands, wherein a first cutter bar provided with cutting blades is immersed with the cutting blades in a first cutting position into the web plane, wherein a second cutter bar provided with cutting blades is immersible with its cutting blades in a second cutting position into the web plane and the first cutter bar is moveable from the first cutting position into a first transfer position outside of the web plane when the second cutter bar is immersed with its cutting blades into the web plane, and wherein a displacing device shifts the second cutter bar from the second cutting position in the opposite direction to the transport direction into the first cutting position, and shifting of the second cutter bar from the second cutting position takes place while the second cutter bar is in the web plane.

2. The cutting device according to claim 1, wherein the first cutter bar is moveable essentially vertically to the web plane from the first cutting position into the first transfer position and/or vice versa' and wherein the second cutter bar is movable essentially vertically to the web plane from the second cutting position into a second transfer position and/or vice versa.

3. A cutting device according to claim 2, wherein the first cutter bar is shiftable along a first guiding device essentially vertically to the web plane and the second cutter bar is shiftable along a second guiding device essentially vertically to the web plane.

4. A cutting device according to claim 3, wherein the first cutter bar and the second cutter bar are releasably attachable to a first cutter bar holder and a second cutter bar holder, respectively.

5. A cutting device according to claim 4, wherein the first cutter bar and the second cutter bar each have a respective accommodation device for accommodating a respective fastening device at the first cutter bar holder and the second cutter bar holder, respectively.

6. A cutting device according to claim 4, wherein the first cutter bar holder is slidably arranged along the first guiding device and the second cutter bar holder is slidably arranged along the second guiding device.

7. A cutting device according to claim 3, further comprising control devices for a fully automatic replacement of the cutter bars as well as for an adjustment of the guiding devices.

8. A cutting device according to claim 2, wherein a transfer carrier for receiving at least one of the cutter bars from the first transfer position or the second transfer position and/or for transferring at least one of the cutter bars into the first transfer position or the second transfer position is moveably arranged between the first transfer position and the second transfer position at a guiding device.

9. A cutting device according to claim 8, wherein the transfer carrier is shiftable along the guiding device from the first transfer position or the second transfer position into a central removal position for replacing the cutter bars.

10. A cutting device according to claim 8, wherein the transfer carrier is shiftable transversally to the transport direction as well as laterally of the film web into a lateral removal position for replacing the cutter bars.

11. A cutting device according to claim 1, further comprising an upstream web carrier as well as a downstream web carrier for guiding the film web to be cut in the web plane, wherein the cutting positions of the cutter bars are arranged between the upstream web carrier and the downstream web carrier.

12. A cutting device according to claim 11, wherein the first cutting position of the first cutter bar is arranged between the upstream web carrier and the downstream web carrier in the transport direction, immediately following the upstream web carrier.

13. A cutting device according to claim 1, wherein a shifter of the displacing device is shiftable in an axial direction in parallel to the web plane.

14. A cutting device according to claim 13, further comprising a drive for shifting the shifter of the displacing device in the axial direction in parallel to the web plane.

15. A cutting device according to claim 1, wherein a first immersion depth into the web plane of the cutting blades provided at the first cutter bar and a second immersion depth into the web plane of the cutting blades provided at the second cutter bar are respectively adjustable in height.

16. A method for longitudinally cutting a film web moved in a web plane in a transport direction into a plurality of film bands by means of the cutting device according to claim 1, comprising:

immersing the first cutter bar provided with the cutting blades of the first cutter bar with its cutting blades in the first cutting position into the web plane of the film web to cut the film web into the plurality of film hands, immersing the second cutter bar provided with the cutting blades of the second cutter bar with its cutting blades in the second cutting position into the web plane, wherein the cutting blades of the second cutter bar each engage in a respective space between the film bands already cut in the longitudinal direction, moving the first cutter bar from the first cutting position into the first transfer position outside of the web plane.

* * * * *